United States Patent [19]

Nassry et al.

[11] 4,313,836

[45] Feb. 2, 1982

[54] WATER-BASED HYDRAULIC FLUID AND METALWORKING LUBRICANT

[75] Inventors: Assadullah Nassry, Riverview; Jerrold F. Maxwell, Woodhaven; John W. Compton, Taylor, all of Mich.

[73] Assignee: BASF Wyandotte Corporation, Wyandotte, Mich.

[21] Appl. No.: 211,606

[22] Filed: Dec. 1, 1980

[51] Int. Cl.[3] ..... C10M 3/42

[52] U.S. Cl. ..... 252/32.7 E; 252/32.5; 252/49.3; 252/49.5; 252/78.5

[58] Field of Search ..... 252/32.5, 46.7, 49.3, 252/49.5, 78.5, 32.7 E

[56] References Cited

U.S. PATENT DOCUMENTS

| | | | |
|---|---|---|---|
| 3,277,001 | 10/1966 | Fischer et al. | 252/32.5 |
| 3,402,188 | 9/1968 | Wiese | 252/32.5 X |
| 3,422,166 | 1/1969 | Davis | 252/32.5 X |
| 3,496,104 | 2/1970 | Shimada et al. | 252/32.5 |
| 3,933,660 | 1/1976 | Tadenuma et al. | 252/32.5 |
| 3,945,930 | 3/1976 | Sugiyama et al. | 252/32.5 |
| 4,051,099 | 9/1977 | von der Crone | 260/326.1 X |
| 4,116,872 | 9/1978 | Jahnke | 252/32.5 X |
| 4,138,346 | 2/1979 | Nassry et al. | 252/32.5 |
| 4,151,099 | 4/1979 | Nassry et al. | 252/49.5 X |
| 4,257,902 | 3/1981 | Singer | 252/32.5 X |

FOREIGN PATENT DOCUMENTS

| | | | |
|---|---|---|---|
| 1319121 | 6/1973 | United Kingdom | 252/32.5 |

*Primary Examiner*—Andrew Metz

*Attorney, Agent, or Firm*—Bernhard R. Swick

[57] ABSTRACT

The present invention relates to the use, as a hydraulic fluid or metalworking lubricant, of compositions having water as a base and yet possessing superior lubricating and wear preventing characteristics. The fluids of the invention comprise (1) a sulfurized molybdenum or antimony compound and (2) a phosphate ester or salt thereof. The compositions can be thickened, if desired, using for instance polyglycol, polyacrylic and polyvinyl alcohol-type thickeners. The use of corrosion inhibitors, metal deactivators and other adjuvants conventional in this art is also contemplated.

12 Claims, No Drawings

WATER-BASED HYDRAULIC FLUID AND METALWORKING LUBRICANT

BACKGROUND OF THE INVENTION

1. Field of the Invention

This invention relates to water-based hydraulic fluids and metalworking compositions.

2. Prior Art

In the technology of hydraulic power transmission, mechanical power is imparted to a fluid called "a hydraulic fluid" in the form of pressure by means of a hydraulic pump. Power is utilized where desired by tapping a source of said hydraulic fluid thus transforming the power as pressure back to mechanical motion by a mechanism called a hydraulic motor. The hydraulic fluid is utilized as a pressure and volume transmitting medium. Any non-compressible fluid can perform this function. Water is the oldest fluid used for this purpose and is still sometimes used alone for this purpose. In the prior art, there has been a heavy emphasis on the development of petroleum oils for use as hydraulic fluids and, consequently, much of the equipment utilized with hydraulic fluids has been designed and manufactured specifically for use with petroleum oils. A petroleum oil in comparison with water as a hydraulic fluid possesses the advantage of inhibiting the development of rust of the ferrous components of the mechanical equipment utilized in conjunction with hydraulic fluids, (i.e., hydraulic pumps, motors, etc.) and in preventing wear of the machinery since the hydraulic fluid must lubricate the equipment. Petroleum oils have a second advantage over the use of water as a hydraulic fluid in that the petroleum oils normally exhibit a substantially higher viscosity than water and thus contribute to reduction of the leakage of the fluid in the mechanical equipment utilized. In addition, the technology relating to additives for petroleum oils has developed to such an extent that the viscosity, foam stability, wear prevention and corrosion prevention properties of such petroleum oil-based hydraulic fluids can be further enhanced by the use of said additives.

Over the past 25 years, various substitutes for petroleum oil-based hydraulic fluids have been developed in order to overcome one of the major deficiencies of petroleum oils, namely, flammability. Recent interest in the use of hydraulic fluids having up to 99 percent or more of water has resulted from the higher cost of petroleum oils and recent emphasis on problems of ecologically suitable disposal of contaminated or spent petroleum oil-based hydraulic fluids.

Metalworking fluids of the so-called "soluble oil" type have been considered for use as hydraulic fluids. Such fluids contain mineral oil and emulsifiers as well as various additives to increase corrosion resistance and improve antiwear and defoaming properties. Such fluids, when used as hydraulic fluids, are not generally suitable for use in ordinary industrial equipment designed specifically for use with the petroleum oil-based hydraulic fluids since such fluids do not adequately prevent wear damage in pumps and valves of such equipment. However, such fluids have found application in specially designed, high cost, large size equipment which, because of said large size and thus inflexibility, is not suitable for use in most industrial plants. The soluble oil hydraulic fluid usage has thus been quite limited; usage has been largely confined to large installations where flexibility and size are not critical, such as in steel mills.

It is known from U.S. Pat. No. 3,249,538 to prepare an aqueous lubricant concentrate and lubricating composition consisting essentially of molybdenum disulfide and a water-soluble viscosity increasing agent such as polyvinyl alcohol and an emulsifiable mineral oil. It is also known from U.S. Pat. No. 3,970,569 to prepare aqueous lubricating compositions containing a water-soluble mixed ester obtained by transesterification of a polyoxyethylene glycol and a triglyceride.

It is also known from U.S. Pat. No. 3,933,658 that a mixture of a phosphate ester and a sulfur compound can be used in a water-based metalworking composition to obtain extreme pressure, antiwear and corrosion inhibiting properties. Such additives are used with a suitable vehicle such as mineral oil, vegetable oil, aliphatic acid ester, etc. The sulfur compounds disclosed are not sulfurized molybdenum compounds but rather are derivatives of 2-mercaptobenzothiazole. The phosphate esters and salts of the instant invention, however, are similar to those disclosed in this reference. These are alkylene oxide derivatives of an alkyl, aryl or aralalkyl phosphate which are converted in situ from the free acid form to the neutralized form wherein the phosphate ester is neutralized with an alkali or alkaline earth metal hydroxide or carbonate, ammonia or an amine. The use of these phosphate ester acids and the sodium or triethanolamine salts thereof in water-based metalworking fluids is suggested in ASLE Transactions 7, pages 398 to 405, at page 405.

It is also known to use, in equipment designed for use in mineral oil-based hydraulic fluids, flame-resistant glycol-water based hydraulic fluids such as are disclosed in U.S. Pat. No. 2,947,699. Up until now, water-based hydraulic fluids containing about 70 to 95 percent water, have had very poor lubricating characteristics. While hydraulic fluids are used primarily to transmit forces, it is necessary that they provide lubrication for the impeller, rings, vanes, gears, pistons and cylinders and other mechanical parts of hydraulic pumps in such systems in order to prevent excessive wear on such parts.

Many prior art fluids, such as the petroleum oil type, are highly flammable and unsuitable for certain uses where such fluids have frequently been the source of fire. Where these fluids are used to control such industrial operations as heavy casting machines, which are operated largely by hydraulic means, danger of fire exists. Therefore, there is a growing demand for hydraulic fluids characterized by reduced flammability.

Hydraulic fluids obtained by blending water and a synergistic mixture of a phosphate ester, with a sulfur-containing compound, etc., and where desirable, a polyglycol type polymeric thickener to increase viscosity are disclosed in U.S. Pat. No. 4,138,346. The sulfur compounds employed in the patent are ammonia, amine or metal salts of 2-mercaptobenzothiazole or 5-, 6-, or 7-substituted 2-mercaptobenzothiazole.

Molybdenum oxide phosphorodithioates are disclosed in U.S. Pat. No. 3,402,188 as useful as additives in power transmitting fluids. It appears that the power transmitting fluids with which these compounds may be used are those which are soluble in hydrocarbon compositions in view of the statement at the beginning of the patent:

"Those which are soluble in hydrocarbon compositions have found uses as additives in gasolines, fuel oils, lubricating oils and greases, cutting oils, transformer oils, hydraulic fluids, and other power transmitting fluids."

A hydraulic fluid or metalworking lubricant, of compositions having water as a base and yet possessing superior lubricating and wear preventing characteristics, is disclosed in U.S. Pat. No. 4,151,099. The fluids comprise (1) a water-soluble polyoxyethylated ester of an aliphatic acid and a monohydric or polyhydric aliphatic alcohol, either one or both said acid and said alcohol being polyoxyethylated, (2) a sulfurized molybdenum or antimony compound or *alternatively* mixtures of (1) and (2) with (3) a phosphate ester salt. In accordance with this patent, the water-soluble polyoxyethylated ester (1) is an essential component while the phosphate ester salt (3) may be employed but is not essential.

In no one of the references discussed above is there any suggestion that a water-based hydraulic fluid or metalworking lubricant can be provided by combining (1) a sulfurized molybdenum or antimony compound with (2) a phosphate ester or salt thereof.

SUMMARY OF THE INVENTION

A water-based hydraulic fluid or metalworking composition can be obtained by blending water, a sulfurized molybdenum or antimony compound and a phosphate ester or salt thereof. As used hereinafter, the expression "phosphate ester" also includes salts of said phosphate ester. Stable concentrates of these ingredients can be prepared with water, and where desirable, the compositions can be thickened with a polyglycol type thickener, a polyacrylate thickener, or other thickeners known to those skilled in the art such as sorbitol, polyvinyl pyrrolidone, and polyvinyl alcohol. Corrosion inhibiting agents can also be added to the compositions to obtain increased corrosion resistance.

The molybdenum compound utilized can be sulfurized oxymolybdenum organo-phosphorodithioate. Antimony compounds of similar structure are useful.

The concentrates of the invention can be used when blended with a substantial amount of water as a flame-retardant hydraulic fluid having excellent lubricity and antiwear characteristics or as metalworking compositions used to cool and lubricate surfaces which are in frictional contact such as during the operations of turning, cutting, peeling, grinding metals and the like. The hydraulic fluids and metalworking compositions of the invention are ecologically superior to those fluids and metalworking emulsions of the prior art containing mineral oil or a glycol/water mixture.

DESCRIPTION OF THE THE PREFERRED EMBODIMENTS

In accordance with this invention, there are disclosed hydraulic fluids, metalworking fluids and lubricating concentrates, which can be diluted with water, as a base to prepare hydraulic fluids or metalworking compositions. The disclosed compositions provide the desirable lubricity as well as antiwear properties which are necessary in a hydraulic fluid or a metalworking composition. The use of a phosphate ester with a combination of water and sulfurized molybdenum or antimony compound results in hydraulic fluids showing synergistic improvements in performance. As is conventional in this art, corrosion inhibiting agents, defoamers, viscosity increasing agents and metal deactivators (chelating agents) can be utilized as part of the compositions of the invention.

THE SULFURIZED MOLYBDENUM AND ANTIMONY COMPOUNDS

The sulfurized oxymolybdenum or oxyantimony organophosphorodithioate additives of the invention are represented by the formula:

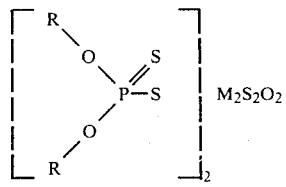

wherein M is molybdenum or antimony and R is organic and is selected from the group consisting of $C_3$–$C_{20}$ alkyl, aryl, alkylaryl radicals and mixtures thereof.

Representative useful molybdenum and antimony compounds are oxymolybdenum and oxyantimony organo-phosphorordithioate where the organic portion is alkyl, aryl or alkylaryl and wherein said alkyl has a chain length of 3 to 20 carbon atoms.

THE PHOSPHATE ESTERS

The compositions of the invention contain a phosphate ester selected from the group consisting of

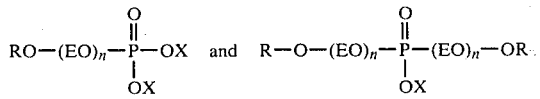

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X preferably is selected from the group consisting of hydrogen, alkali or alkaline earth metal, the residue of ammonia or an amine and mixtures thereof, and n is a number from 1 to 50. Metals such as lithium, sodium, potassium, rubidium, cesium, calcium, strontium, and barium are examples of the alkali or alkaline earth metal.

The free acid form of the phosphate ester is utilized in preparing the compositions of the invention. These are more fully disclosed in U.S. Pat. Nos. 3,004,056 and 3,004,057, incorporated herein by reference. The free acid form may be converted to the salt form in situ in the preparation of the fluids of the invention. Alternatively, the phospate ester salts can be used directly.

The free acid form of the phosphate ester is generally obtained by esterifying 1 mole of phosphorus pentoxide with 2 to 4.5 moles of a nonionic surface-active agent obtained by condensing at least 1 mole of ethylene oxide with 1 mole of a compound having at least 6 carbon atoms and a reactive hydrogen atoms. These nonionic surface-active agents are well known in the art and are generally prepared by condensing a polyglycol ether containing a suitable number of alkanoxy groups or a 1,2-alkylene oxide, or a subsitituted alkylene oxide such as a substituted propylene oxide, butylene oxide or preferably ethylene oxide with an organic compound containing at least 6 carbon atoms and a reactive hydrogen atom. Examples of compounds containing a reactive hydrogen atom are alcohols, phenols, thiols, primary and secondary amines and carboxylic and sulfonic acids and their amides. The amount of alkylene oxide or equivalent condensed with a reactive chain will generally depend upon the particular compound employed. About 20 to 85 percent by weight of combined alkylene oxide is generally obtained in a condensation product, however, the optimum amount of alkylene oxide or equivalent utilized will depend upon the desired hydrophobic-lipophilic balance desired.

Preferably, the nonionic surface-active agents utilized are derivatives of alkylated and polyalkylated phenols, multibranched chain primary aliphatic alcohols having the molecular configuration of an alcohol and are produced by the Oxo process from a polyolefin of at least 7 carbon atoms or straight chain aliphatic alcohols of at least 10 carbon atoms. Examples of suitable nonionic surface-active agent condensation products which can be in turn reacted with phosphorus pentoxide to produce the phosphate esters utilized as additives in the hydraulic fluids of the invention are exemplified below. In this list, "EO" represents "ethylene oxide" and the number preceding this abbreviation refers to the number of moles thereof reacted with 1 mole of the given reactive hydrogen-containing compound.

Nonylphenol+9-11 EO
Nonylphenol+2 EO
Dinonylphenol+7 EO
Dodecylphenol+18 EO
Caster oil+20 EO
Tall Oil+18 EO
Oleyl alcohol+4 EO
Oleyl alcohol+20 EO
Lauryl alcohol+4 EO
Lauryl alcohol+15 EO
Hexadecyl alcohol+12 EO
Hexadecyl alcohol+20 EO
Octadecyl alcohol+20 EO
Oxo tridecyl alcohol:
(From tetrapropylene)+7 EO
(From tetrapropylene)+10 EO
(From tetrapropylene)+15 EO
Dodecyl mercaptan+9 EO
Soya Bean oil amine+10 EO
Rosin amine+32 EO
Coconut fatty acid amine+7 EO
Cocoa fatty acid+10 EO
Dodecylbenzene sulfonamide+10 EO
Decyl sulfonamide+6 EO
Oleic acid+5 EO
Propylene glycol (30 oxypropylene units)+10 EO While it is known that the phosphate ester salts of the invention, as described, can contribute to the antiwear and extreme pressure performance characteristics of a lubricant composition, it has been found that a synergistic improvement in such properties is obtained by the combination of the phosphate ester salts with the sulfurized molybdenum or antimony compound of the invention.

The hydraulic fluids and metalworking compositions of the invention generally consist of about 60 percent to about 99 percent water and about 40 percent to about 1 percent of additives. These additives can consist of concentrates comprising combinations of the molybdenum or antimony compounds with the phosphate ester, and, in addition, can contain polymeric thickening agents, defoamers, corrosion inhibitors and metal deactivators or chelating agents. Preferably, said fluids consist of about 75 percent to 99 percent water and about 25 percent to about 1 percent concentrate. The fluids are easily formulated at room temperature using distilled or deionized water although tap water can also be used without adverse effects on the fluid properties.

Stable concentrates of the hydraulic fluids and metalworking compositions of the invention can be prepared. These can be made up completely free of water as indicated in Table I below or contain any desired amount of water but preferably contain up to 75 percent by weight of water to increase fluidity and provide ease of blending at the point of use. These concentrates are typically diluted with water in the proportion of 1:99 to 10:90.

Representative concentrates are as follows:

TABLE I

| Ingredient | % by Weight | | | | | |
|---|---|---|---|---|---|---|
| Phosphate ester of the invention | 11 | 17 | 11 | 7 | 20 | 13 |
| Sulfurized oxymolybdenum or antimony organo-phosphorodithioate at 40% solids | 33 | 33 | 56 | 71 | 50 | 67 |
| Sodium-2-mercaptobenzo-thiazole | 28 | 17 | 11 | 7 | 10 | 7 |
| Isopropylaminoethanol or morpholine | 28 | 33 | 22 | 15 | 20 | 13 |

The proportions of phosphate ester to sulfurized molybdenum or antimony compound of the invention are generally about 0.1:1 to about 2.5:1 based upon the weight of the sulfur in the sulfurized molybdenum or antimony compound. Preferably, the proportion of phosphate ester to sulfurized molybdenum or antimony compound is 0.5:1 to 1:2.5.

The concentration of sulfurized molybdenum or antimony compound to water in the hydraulic fluid or metalworking compositions of the invention is generally about 0.05 to 5 percent by weight and the concentration of the phosphate ester to water in the hydraulic fluid or metalworking compositions of the invention is generally about 0.05 to 1 percent by weight.

The thickeners, metal deactivators and corrosion inhibitors which can be added either to the concentrate or to the hydraulic fluid or metalworking compositions of the invention are as follows:

LIQUID-VAPOR PHASE CORROSION INHIBITORS

The liquid-vapor corrosion inhibitor can be any of the alkali metal nitrites, nitrates and benzoates. Certain amines are also useful. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calclium benzoate, barium benzoate, lithium benzoate and strontium benzoate.

Representative amine-type corrosion inhibitors are morpholine, N-methylmorpholine, N-ethylmorpholine, ethylenediamine, diemthylaminopropylamine, N,N-dimethylethanolamine, $\alpha$- and $\gamma$-picoline, piperazine and isopropylaminoethanol. These amines also function to neutralize the free acid form of the phosphate ester converting it to the salt form.

Particularly preferred vapor phase corrosion inhibiting compounds are morpholine and isopropylaminoethanol. As corrosion inhibitors, a concentration to water of about 0.05 to 2 percent by weight is used.

It is also contemplated to add other known corrosion inhibitors. Besides the amines, alkali metal nitrates, benzoates and nitrites listed above, the alkoxylated fatty acids are useful as corrosion inhibitors.

METAL DEACTIVATORS (CHELATING AGENTS)

The metal deactivators are used primarily to chelate copper and copper alloys. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolytriazole, 2-mercaptobenzothiazole, sodium 2-mercaptobenzothiazole, and N,N'-disalicylidene-1,2-propanediamine. The concentration of metal deactivator to water in the hydraulic fluid or metalworking compositions of the invention is generally about 0.05 to 2.0 percent by weight.

THE THICKENER

Depending upon the anticipated conditions of use, it may be desirable to utilize in the hydraulic fluid and metalworking compositions of the invention a thickener. The thickener can be of the polyglycol type. Such thickeners are well known in the art and this type of thickener is the preferred thickener since it has particular advantages from the standpoint of providing Newtonian viscosity characteristics under varying shear conditions. The polyglycol thickeners are polyoxyalkylene polyols prepared by reacting an alkylene oxide with a linear or branched chain polyhydric alcohol. These polyols contain ethylene oxide and propylene oxide in a mole ratio of between about 100:0 to about 70:30 ethylene oxide-propylene oxide. These thickeners are commercially available and sold under the trademark "Ucon 75H-90,000" by Union Carbide and Carbon Chemical Corporation. The specifications for this material call for a pour point of 40° F., a flash point of 485° F., a specific gravity at 20° C. of 1.95 and a viscosity of about 90,000 S.U.S. at a temperature of 100° F. Generally, about 2 percent to about 20 percent is used based upon the total weight of the hydraulic fluid or metalworking additive composition of the invention, preferably, about 5 percent to about 15 percent of polyglycol thickener is used.

Other types of viscosity increasing agents can be used in the hydraulic fluid and metalworking compositions of the invention such as polyvinyl alcohol, polymerization products of acrylic acid and methacrylic acid, polyvinyl pyrrolidone polyvinyl ether maleic anhydride copolymer and sorbitol. These materials are well known in the art and are utilized in varying proportions depending upon the desired viscosity and the efficiency of the thickening or viscosity increasing effect. Generally, about 3 percent to about 15 percent of such thickeners will provide desired viscosity of about 100 S.U.S. at 100° F. in the hydraulic fluid or metal-working composition of the invention. By the use of such thickening agents, it is believed that the hydraulic fluids of the invention can be used in hydraulic pumps and other equipment without significant wear resulting from cavitation effects and use of such thickeners also substantially prevents internal and external leakage in the mechanical parts of the hydraulic system during the pumping of such hydraulic fluids.

The phosphate esters are water-soluble in the sense that no special method is required to disperse these materials in water and keep them in suspension over long periods of time. As a means of reducing corrosion, the pH of the water in the fluids of the invention is maintained above 7.0, preferably 7.0 to about 11.0, and most preferably 7.5 to about 9.0. Preferably, pH of the fluid concentrates is adjusted with an alkali metal or alkaline earth metal hydroxide, or carbonate, ammonia or an amine. The sulfurized molybdenum or antimony compounds on the other hand are insoluble in water and require emulsification prior to use, for instance, with anionic or nonionic surfactants. Useful representative anionic or nonionic surfactants are: sodium petroleum sulfonate, i.e., sodium dodecylbenzene sulfonate; polyoxyethylated fatty alcohol or fatty acid and polyoxyethylated alkyl phenol.

A typical recipe for the emulsification of the sulfurized molybdenum or antimony compound of the invention (sulfurized oxymolybdenum or oxyantimony organo-phosphorodithioates) is as follows:

| | % by Weight |
|---|---|
| Emulsifier | |
| Sodium dodecylbenzene sulfonate | 70 |
| Ethylene glycol monobutyl ether | 23 |
| Butyl alcohol | 7 |
| | 100 |
| Emulsifiable Concentrate | |
| (hereafter termed emulsion) | |
| Sulfurized molybdenum or antimony compound | 40 |
| Emulsifier | 6 |
| | 100 |

A typical high water-base hydraulic fluid or metalworking additive of the invention will contain the components shown in Table II.

TABLE II

Typical Composition of Hydraulic Fluid or Metalworking Additive

| Component | % by Weight |
|---|---|
| Water (distilled or deionized) | 95-75 |
| Polymeric thickener | 0-15 |
| Molybdenum or antimony compound at 40 percent solids in emulsifier | 2.5-5 |
| Water-soluble alkyl phosphate ester | 0.1-1.0 |
| Metal deactivator | 0.1-0.5 |
| Corrosion inhibitor | 0.5-1.0 |

The hydraulic fluid and metalworking compositions of the invention, when formulated as above, are transparent liquids having a viscosity of up to 400 S.U.S. at 100° F., which are stable over long periods of storage at ambient temperature. In addition, the hydraulic fluids and metal-working additives of the invention are oil-free and will not support combustion in contrast to those flame-resistant fluids of the prior art based upon a glycol and water or petroleum oils. The hydraulic fluids and metalworking additives of the invention are ecologically clean and non-polluting composition when compared to existing petroleum-based hydraulic fluids. Since the hydraulic fluids and metalworking additives of the invention are largely based upon synthetic materials which are not derived from petroleum, the production of such fluids is relatively independent of shortages of petroleum oil and not materially influenced by the economic impact of such shortages.

The hydraulic fluids of the invention can be used in various applications requiring hydraulic pressures in the range of 200–2,000 pounds per square inch since they have all the essential properties required such as lubricity, viscosity and corrosion protection. They are suitable for use in various types of hydraulic systems and are especially useful in systems in which vane-type pumps or the axial-piston pumps are used. Such pumps are used in hydraulic systems where pressure is required for molding, clamping, pressing metals, actuating devices such as doors, elevators, and other machinery or for closing dies in die-casting machines and in injection molding equipment and other applications.

In evaluating the hydraulic fluids of the invention, a test generally referred to as the Vickers Vane Pump Test is employed. The apparatus used in this test is a hydraulic system which functions as follows: Hydraulic fluid is drawn from a closed sump to the intake side of a Vickers V-104C vane-type pump. The pump is driven by, and directly coupled to, a twenty-five horsepower, 1740 rpm electric motor. The fluid is discharged from the pump through a pressure regulating valve. From there it passes through a calibrated venturi (used to measure flow rate) and back to the sump. Cooling of the fluid is accomplished by a heat exchanger through which cold water is circulated. No external heat is required; the fluid temperature being raised by the frictional heat resulting from the pump's work on the fluid. Excess heat is removed by passing the fluid through the heat exchanger prior to return to the sump. The Vickers V-104C vane-type pump comprises a cylindrical enclosure (the pump body) in which there is housed a so-called "pump cartridge". The "pump cartridge" assembly consists of front and rear circular, bronze bushings, a rotor, a cam-ring and rectangular vanes. The bushings and cam-ring are supported by the body of the pump and the rotor is connected to a shaft which is turned by an electric motor. A plurality of removable vanes are inserted into slots in the periphery of the rotor. The cam-ring encircles the rotor and the rotor and vanes are enclosed by the cam-ring and bushings. The inner surface of the cam-ring is cam-shaped. Turning the rotor results in a change in displacement of each cavity enclosed by the rotor, the cam-ring, two adjacent vanes and the bushings. The body is ported to allow fluid to enter and leave the cavity as rotation occurs.

The Vickers Vane Pump Test procedure used herein specifically requires charging the system with 5 gallons of the test fluid and running at temperatures ranging from 100° to 135° F. at 750 to 1000 psi pump discharge pressure (load). Wear data were made by weighing the cam-ring and the vanes of the "pump cartridge" before and after the test. At the conclusion of the test run and upon disassembly for weighing, visual examination of the system was made for signs of deposits, varnish, corrosion, etc.

The following examples more fully describe the hydraulic fluids of the invention and show the unexpected results obtained by their use. The examples are intended for the purpose of illustration and are not to be construed as limiting in any way. All parts and percentages are by weight and all temperatures are in degrees centigrade unless otherwise noted.

EXAMPLE 1

(Comparative Example)

A water-based hydraulic fluid was prepared by blending 1.0 percent of a straight-chain alkyl phosphate ester sold under the trademark ANTARA LB 400 with 12.65 percent of a polyglycol thickener sold under the trademark PLURACOL V-10, 0.5 percent of sodium-2-mercaptobenzothiazole and 1.0 percent mixed isopropylamino ethanol were added as metal deactivator (chelating agent) and corrosion inhibitor respectively. The amines also convert the free acid form of the phosphate ester to the salt form by an in situ reaction. The balance of the fluid is deionized water. The fluid obtained was clear and had a viscosity of 73 S.U.S. at 100° F. Upon evaluation in the Vickers Vane Pump Test under conditions of 750 pounds per square inch load, 1200 rpm speed; the test being allowed to run for 20 hours and the hydraulic fluid being maintained at the temperature of 100° F., the wear loss obtained was 1299 milligrams.

EXAMPLE 2

(Comparative Example)

A water-based hydraulic fluid was prepared by blending 2.5 percent of a 40 percent solids emulsion of a sulfurized oxymolybdenum-organophosphorodithioate sold under the trademark VANLUBE 723 by the R. T. Vanderbilt Company with 12.65 percent of a polyglycol thickener sold under the trademark PLURACOL V-10 and 0.5 percent of sodium-2-mercaptobenzothiazole as metal deactivator (chelating agent) and 1 percent mixed isopropylaminoethanol as corrosion inhibitor. The balance of the fluid is deionized water. The fluid obtained was clear and had a viscosity of 83 S.U.S. at 100° F. Upon evaluation in the Vickers Vane Pump Test under conditions of 750 pounds per square inch load, 1200 rpm speed; the test being allowed to run for 22 hours and the hydraulic fluid being maintained at the temperature of 100° F., the wear loss obtained was 409 milligrams.

EXAMPLE 3

A water-based hydraulic fluid was prepared by blending 1.0 percent of a straight-chain alkyl phosphate ester sold under the trademark ANTARA LB 400 and 2.5 percent of a 40 percent solids emulsion of a sulfurized oxymolybdenum-organophosphorodithioate sold under the trademark VANLUBE 723 by the R. T. Vanderbilt Company. In addition, 12.65 percent of a polyglycol thickener sold under the trademark PLURACOL V-10 and 0.5 percent of sodium-2-mercaptobenzothiazole as metal deactivator (chelating agent) and 1 percent mixed isopropylaminoethanol as corrosion inhibitor. The balance of the fluid is deionized water. The fluid obtained was clear and had a viscosity of 83–85 S.U.S. at 100° F. Upon evaluation in the Vickers Vane Pump Test under conditions of 750 pounds per square inch load, 1200 rpm speed; the test being allowed to run for 20 hours and the hydraulic fluid being maintained at the temperature of 100°0 F., the wear loss obtained was 178 milligrams.

Comparative performance of the hydraulic fluids prepared in Examples 1–3 is presented in Table III below. As indicated in Table III, the hydraulic fluid of Example 3 provides a marked improvement over the results obtained for the fluids of Examples 1 and 2.

TABLE III

| Vickers Vane Pump Wear Results With Hydraulic Fluids of Invention | |
|---|---|
| Hydraulic Fluid Example No. | Wear Weight Loss 1.1 (mg.) Total |
| 1 (Comparative Example) | 1299 |
| 2 (Comparative Example) | 409 |
| 3 | 178 |

1. Conditions: Vickers Vane Pump, V-104C, 20 hours running time, 750 psi load at 100° F., 1200 rpm speed.

EXAMPLE 4

(Comparative Example)

A water-based hydraulic fluid was prepared by blending 5.0 percent of a 40 percent solids emulsion of a sulfurized oxymolybdenum-organophosphorodithioate sold under the trademark VANLUBE 723 by the R. T. Vanderbilt Company with 12.65 percent of a polyglycol thickener sold under the trademark PLURACOL V-10 and 0.5 percent of sodium-2-mercaptobenzothiazole as metal deactivator (chelating agent) and 1.0 percent mixed isopropylaminoethanol as corrosion inhibitor. The balance of the fluid is deionized water. The fluid obtained was clear and had a viscosity of 89 S.U.S. at 100° F. Upon evaluation in the Vickers Vane Pump Test under conditions of 750 pounds per square inch load, 1200 rpm speed; the test being allowed to run for 20 hours and the hydraulic fluid being maintained at the temperature of 100° F., the wear loss obtained was 327 milligrams.

EXAMPLE 5

A water-based hydraulic fluid was prepared by blending 0.5 percent of a straight-chain $C_{18}$ alkyl phosphate ester and 5.0 percent of a 40 percent solids emulsion of a sulfurized oxymolybdenum-organophosphorodithioate sold under the trademark VANLUBE 723 by the R. T. Vanderbilt Company. In addition, 12.65 percent of a polyglycol thickener sold under the trademark PLURACOL V-10 and 0.5 percent of sodium-2-mercaptobenzothiazole as metal deactivator (chelating agent) and 1.0 percent mixed isopropylaminoethanol as corrosion inhibitor were added. The balance of the fluid is deionized water. The fluid obtained was clear and had a viscosity of 90–100 S.U.S. at 100° F. Upon evaluation in the Vickers Vane Pump Test under conditions of 750 pounds per square inch load, 1200 rpm speed; the test being allowed to run for 20 hours and the hydraulic fluid being maintained at the temperature of 100° F., the wear loss obtained was 245 milligrams.

EXAMPLE 6

A water-based hydraulic fluid was prepared by blending 1.0 percent of a straight-chain $C_{18}$ alklyl phosphate ester and 5.0 percent of a 40 percent solids emulsion of a sulfurized oxymolybdenum-organophosphorodithioate sold under the trademark VANLUBE 723 by the R. T. Vanderbilt Company. In addition, 12.65 percent of a polyglycol thickener sold under the trademark PLURACOL V-10 and 0.5 percent of sodium-2-mercaptobenzothiazole as metal deactivator (chelating agent) and 1.0 percent mixed isopropylaminoethanol as corrosion inhibitor were added. The balance of the fluid is deionized water. The fluid obtained was clear and had a viscosity of 90–120 S.U.S. at 100° F. Upon evaluation in the Vickers Vane Pump Test under conditions of 750 pounds per square inch load, 1200 rpm speed; the test being allowed to run for 22 hours and the hydraulic fluid being maintained at the temperature of 100° F., the wear loss obtained was 169 milligrams.

Comparative performance of the hydraulic fluids prepared in Examples 4–6 is presented in Table IV below. As indicated in Table IV, the hydraulic fluids of Examples 5 and 6 provide a marked improvement over the results obtained for the fluid of Example 4.

TABLE IV

| Vickers Vane Pump Wear Results With Hydraulic Fluids of the Invention | |
|---|---|
| Hydraulic Fluids Example No. | Wear Weight Loss 1.1 (mg.) Total |
| 4 (Comparative Example) | 327 |
| 5 | 245 |
| 6 | 169 |

1. Conditions: Vickers Vane Pump, V-104C, 20 hours running time, 750 psi load at 100° F., 1200 rpm speed.

EXAMPLE 7

In the same manner as described in Example 6, a water-based hydraulic fluid is prepared using, in lieu of the VANLUBE 723 organophosphorodithioate compound, a sulfurized oxymolybdenum organophosphorodithioate additive represented by the formula:

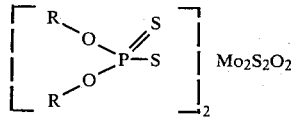

wherein R is a $C_{10}$ alkyl radical. This compound is emulsified in water using 1.2 percent of a 1:1 blend of the nonionic surfactants sold under the trademarks PLURAFAC D-25 and PLURAFAC A-24 by the BASF Wyandotte Corporation. The free acid form of an alkylphosphate ester obtained by the reaction of 2 moles of phosphorus pentoxide with the surface-active agent condensation product obtained by reacting one mole of oleyl alcohol and four moles of ethylene oxide is employed in lieu of the phosphate ester of Example 6.

The embodiments of the invention in which an exclusive privilege or property is claimed are defined as follows:

1. A hydraulic fluid or metalworking fluid concentrate consisting essentially of:

A. a sulfurized metallic compound of the formula:

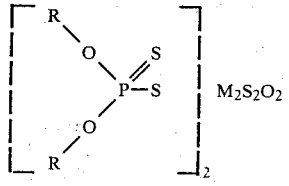

wherein M is molybdenum or antimony and wherein R is selected from the group consisting of alkyl, aryl, alkylaryl radicals and mixtures thereof having 3 to 20 carbon atoms in the alkyl group, B. a phosphate ester selected from the group consisting of

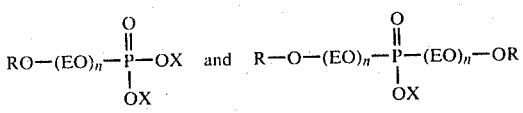

and mixtures thereof, wherein EO represents ethylene oxide groups; R is selected from the group consisting of linear or branched chain alkyl groups having about 6 to 30 carbon atoms or alkylaryl groups wherein the alkyl groups have 6 to 30 carbon atoms; X is selected from the group consisting of hydrogen, alkali or alkaline earth metal, the residual of ammonia or an amine and mixtures thereof and n is a number from 1 to 50 and optionally C. a supplemental additive selected from the group consisting of corrosion inhibitor, thickener, and metal deactivator and mixtures thereof wherein the ratio of said phosphate ester to said sulfurized metallic compound is from about 0.1:1 to 2.5:1 by weight based upon the weight of the sulphur in said metallic compound.

2. The concentrate of claim 1 wherein said sulfurized metallic compound is sulfurized oxymolybdenumorganophosphorodithioate.

3. The concentrate of claim 2 including a corrosion inhibitor in an amount of about 0.05 to 2 percent by weight of the water, a thickener in an amount of about 3 to 15 percent by weight of the total composition, and a metal deactivator in an amount of about 0.05 to 2 percent by weight of the total composition.

4. A hydraulic fluid or metalworking lubricant fluid consisting essentially of the composition of claim 1 and from about 40 to 99 percent by weight water at a pH above 7.

5. The hydraulic fluid of claim 4 wherein said sulfurized metallic compound is sulfurized oxymolybdenumorganophosphorodithioate.

6. The hydraulic fluid of claim 5 including a corrosion inhibitor in an amount of about 0.05 to 2 percent by weight of the water, a thickener in an amount of about 3 to 15 percent by weight of the total composition, and a metal deactivator in an amount of about 0.05 to 2 percent by weight of the total composition.

7. A hydraulic fluid or metalworking fluid concentrate consisting essentially of the composition of claim 1 and up to about 75 percent by weight water at a pH above 7.

8. The concentrate of claim 7 wherein said sulfurized metallic compound is sulfurized oxymolybdenum organophosphorodithioate.

9. The concentrate of claim 8 wherein said phosphate ester is derived from the reaction product of 4 moles of ethylene oxide with one mole of oleyl alcohol esterified by reacting one mole of said reaction product with two moles of phosphorus pentoxide and wherein X is hydrogen.

10. The concentrate of claim 9 including a corrosion inhibitor selected from the group consisting of alkali metal benzoate, nitrate, nitrite, and amine and mixtures thereof, a polyglycol thickener selected from the group consisting of the polyether reaction product of an alkylene oxide with a linear or branched chain polyhydric alcohol and a metal deactivator selected from the group consisting of benzotriazole, tolyltriazole, 2-mercaptobenzothiazole, sodium-2-mercaptobenzothiazole, and N,N'-disalicylidine-1,2-propanediamine.

11. The concentrate of claim 10 wherein said corrosion inhibitor is mixed isopropylaminoethanol and said metal deactivator is sodium-2-mercaptobenzothiazole.

12. In a process for transmitting force hydraulically by applying a force to a confined fluid and said fluid transmits said force to an actuating means which is actuated by the force of said confined fluid, the improvement wherein said confined fluid is the hydraulic fluid of claim 4.

* * * * *